US008393015B2

(12) United States Patent
Jones

(10) Patent No.: US 8,393,015 B2
(45) Date of Patent: Mar. 12, 2013

(54) GARMENT WEIGHTS

(76) Inventor: Catherine Ann Jones, San Rafael, CA (US)

( * ) Notice: Subject to any disclaimer, the term of this patent is extended or adjusted under 35 U.S.C. 154(b) by 0 days.

(21) Appl. No.: 13/218,390

(22) Filed: Aug. 25, 2011

(65) Prior Publication Data

US 2012/0137412 A1 Jun. 7, 2012

Related U.S. Application Data

(63) Continuation-in-part of application No. 11/673,498, filed on Feb. 9, 2007, now abandoned.

(51) Int. Cl.
*A41D 27/00* (2006.01)

(52) U.S. Cl. ..... 2/273; 24/3.11

(58) Field of Classification Search ..... 2/273, 244, 2/334, 302, 132; 24/3.11–3.13, 326, 512; 223/DIG. 1; 160/349.1
See application file for complete search history.

(56) References Cited

U.S. PATENT DOCUMENTS

| | | | | | |
|---|---|---|---|---|---|
| 614,189 | A | * | 11/1898 | Westfelder | 2/273 |
| 724,518 | A | * | 4/1903 | Sutton | 2/334 |
| 1,024,957 | A | * | 4/1912 | Whin | 2/273 |
| 1,062,403 | A | * | 5/1913 | Kahn | 2/273 |
| 1,291,090 | A | * | 1/1919 | Kuzum | 2/145 |
| 1,388,802 | A | * | 8/1921 | Cooper | 2/273 |
| 1,741,060 | A | * | 12/1929 | Levenson | 2/132 |
| 1,828,678 | A | * | 10/1931 | Peterman et al. | 160/349.1 |
| 1,874,871 | A | * | 8/1932 | Bower | 24/334 |
| 1,936,198 | A | * | 11/1933 | Kirsch | 160/349.1 |
| 2,065,831 | A | * | 12/1936 | Smith | 24/299 |
| 2,212,326 | A | * | 8/1940 | Piken | 4/558 |
| 2,432,957 | A | * | 12/1947 | Webster | 211/113 |
| D175,169 | S | * | 7/1955 | Jacobson | D6/326 |
| 3,107,361 | A | * | 10/1963 | Glutting, Sr. | 4/558 |
| 3,131,449 | A | * | 5/1964 | Chiyoichi | 24/334 |
| 3,237,261 | A | * | 3/1966 | Homonoff | 160/349.1 |
| 3,282,328 | A | * | 11/1966 | Mushro et al. | 160/349.1 |
| 4,723,326 | A | * | 2/1988 | Tarlow et al. | 4/608 |
| 5,007,139 | A | * | 4/1991 | Ahern | 24/49.1 |
| 5,404,602 | A | * | 4/1995 | Kondo | 5/504.1 |
| D374,170 | S | * | 10/1996 | Slaski | D8/395 |
| 5,979,021 | A | * | 11/1999 | Swift | 24/66.6 |
| 6,041,454 | A | * | 3/2000 | Summerford | 4/558 |
| 6,425,167 | B1 | * | 7/2002 | Barbarite et al. | 24/298 |

FOREIGN PATENT DOCUMENTS

JP 2000296295 A * 10/2000

* cited by examiner

*Primary Examiner* — Shelley Self
*Assistant Examiner* — Richale Quinn
(74) *Attorney, Agent, or Firm* — West & Associates, A PC; Stuart West; Shaun Sluman

(57) ABSTRACT

A device to hold a garment in place, particularly the event of a gust of air, comprising an attachment member, a connecting member, and a weight, which can be worn either on the inside or outside surface of the garment. In operation the device attaches to a garment and pulls the garment vertically in accordance with gravity.

3 Claims, 5 Drawing Sheets

GARMENT WEIGHTS

CLAIM TO PRIORITY

The present continuation-in-part application claims the benefit of priority to prior-filed, U.S. patent application Ser. No. 11/673,498, filed on Feb. 9, 2007, now abandoned the complete contents of which is hereby incorporated herein by reference.

BACKGROUND

1. Field of the Invention

The present disclosure is for a device that assists in holding a skirt or dress in place.

2. Background

Skirts and dresses are a common form of attire. However, in windy conditions, the lower portion can blow upwards, causing a potentially embarrassing situation for the wearer. Attempts have been made to solve this problem, but these have several shortcomings.

Other devices are merely ornamental, such as that described in U.S. Pat. No. D457,465, entitled "WOMEN'S GARMENT CLIP" to Hollingsworth et al., issued on May 21, 2002. This device is a clip shaped like a human hand. Although it is intended to keep wind from blowing a skirt upward, it can only attach to the "bottom, side, or front of a skirt or dress." Therefore, a user cannot conceal this device and must be content with displaying it as a fashion accessory. The aesthetic design also indicates that it is meant to be seen.

Another ornamental device, described in U.S. Pat. No. 724518, entitled "SKIRT ELEVATOR" to Sutton, issued on Apr. 7, 1903 holds down a skirt in the wind by hanging a set of weights from approximately the waist area of the skirt. The weights hang down at the user's sides on the outside of the skirt, thereby pinning it down to the user's body when a gust of wind tries to raise it up. However, this device must be worn on the outside of the garment in plain sight in order to work. Further, a user may eventually find the weights hanging at her side tiring, and the weights constantly hitting her legs could prove uncomfortable. Another problem with this device is that the clips and weights tend to grab the garment in a way that wrinkles it or pulls it away from a proper fit by not allowing the garment to hang naturally.

Other solutions to this problem involve sewing weights into the hem of a skirt or dress. Although it can be effective, this method permanently alters the skirt. The weights are not easily detachable for washing or on occasions where they are not needed. Further, adding and removing weights from a skirt in this manner can cause excessive wear and tear on the garment.

What is needed is a device that effectively holds a skirt, dress, or other garment in place under windy conditions, while still being concealable, detachable, and harmless to the garment.

DETAILED DESCRIPTION

Figure 1:
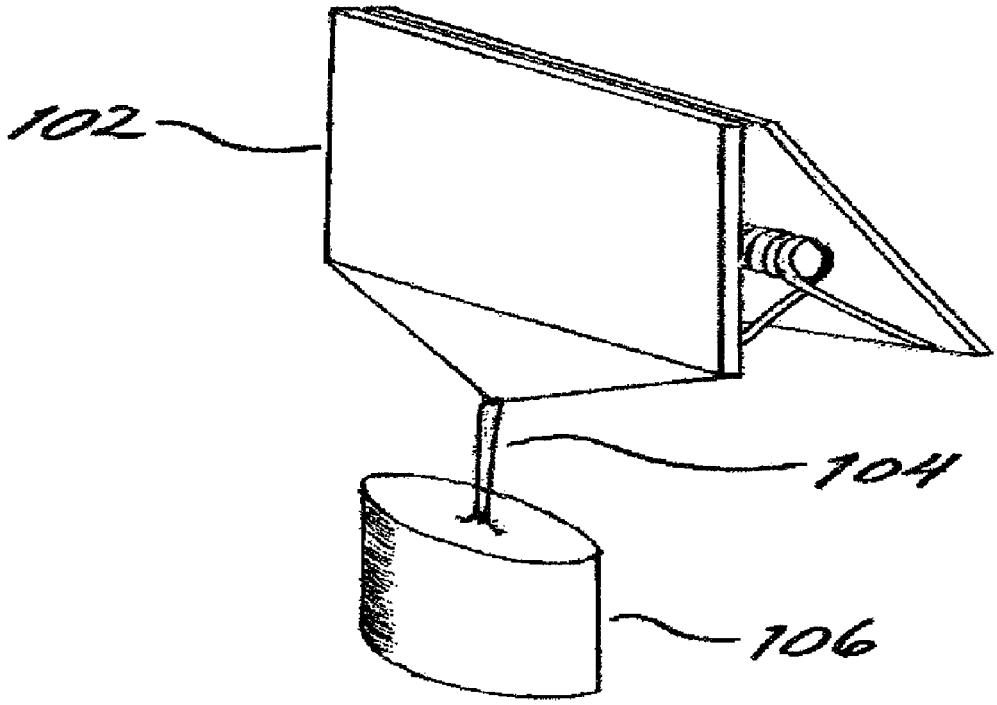
FIG. 1 depicts a perspective view of one embodiment of the present device

FIG. 1 depicts a perspective view of one embodiment of the present device. An attachment member 102 has a proximal and a distal edge. A connecting member 104 having a proximal and a distal end can be connected to the distal end of the attachment member 102. A weight assembly 106 can be connected to the distal end of the connecting member 104.

An attachment member 102 can be a clip, clamp, clasp, adhesive, magnetic coupling, pin, clothespin and/or any other known and/or convenient device. The surfaces of an attachment member 102 that come in contact with the surfaces to which it can be attached can be smooth or textured to enhance the grip of the attachment member 102.

A connecting member 104 can be a cord, loop, strap, chain and/or any other known and/or convenient item capable of connecting the attachment member 102 with the weight assembly 106 having any known and/or convenient elastomeric and/or elastoplastic properties. A connecting member 104 can be removably coupled with an attachment member 102 by a clip, hook, or any other known and/or convenient device. It can also be permanently affixed to an attachment member 102 by adhesive or any other known and/or convenient device.

A weight assembly 106 can be a single mass and/or a plurality of masses (distributed or otherwise geometrically related) of metal, plastic, glass, polymer, or any other known and/or convenient material. A weight assembly 106 can be a regular or irregular geometric shape, an artistic shape, letters, numbers, creatures, or any other known and/or convenient configuration. A weight assembly 106 can be removably coupled with a connecting member 104 by a clip, hook, or any other known and/or convenient device. It can also be permanently affixed to a connecting member 104 by adhesive or any other known and/or convenient devices.

Figure 2:
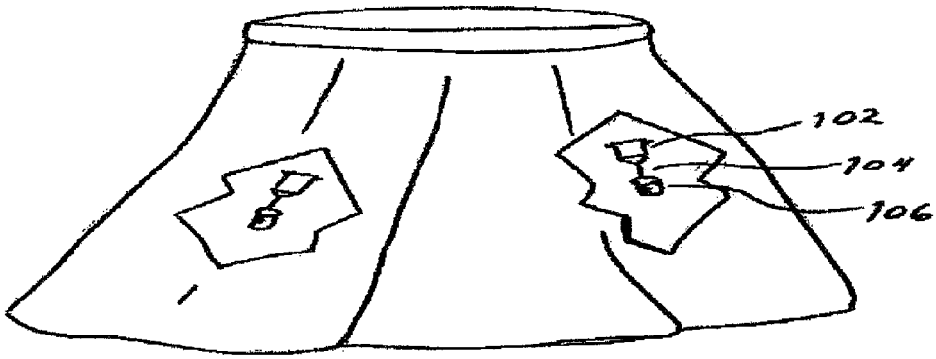
FIG. 2 depicts one embodiment of the present device in use.

FIG. 2 shows an embodiment of the present device in use. A user attaches at least one device in any known and/or convenient location on the body of a garment. In some embodiments a user can attach the device, using the attachment member 104, to the inside of the garment so that the device cannot be seen. FIG. 2 depicts this embodiment by using cutaways views to show devices attached to the inside of a garment. In alternate embodiments, a user can attach it to the outside surface of the garment or along the bottom hemline to make it more conspicuous. In the event that a surge of air, such as a gust of wind appears and attempts to blow the garment upward, the weight assembly 106, that can be coupled with any known and/or convenient garment via an attachment member 102, can assist in holding the garment in place. In some embodiments the device can be attached to a skirt, a kilt, a kimono, a robe and/or any other garment.

In some embodiments, a weight assembly 106 can be removably coupled with a connecting member 104. In other embodiments, a weight assembly 106 can be permanently affixed to a connecting member 104, which can then be removably coupled with an attachment member 102 with or without the connecting member 104. In some embodiments, a weight assembly 106 and/or a connecting member 104 can be interchangeable. In some embodiments, a user could change a weight assembly 106 to provide more or less resistance against the force of a gust of wind. Also, in some embodiments a user could interchange an attachment member 102, a connecting member 104, or a weight 106 for aesthetic purposes. In still further alternate embodiments, the attachment member 102, the connecting member 104, the weight and/or any known and/or convenient portion of the device can be integrated with any known and/or convenient garment.

Figure 3:
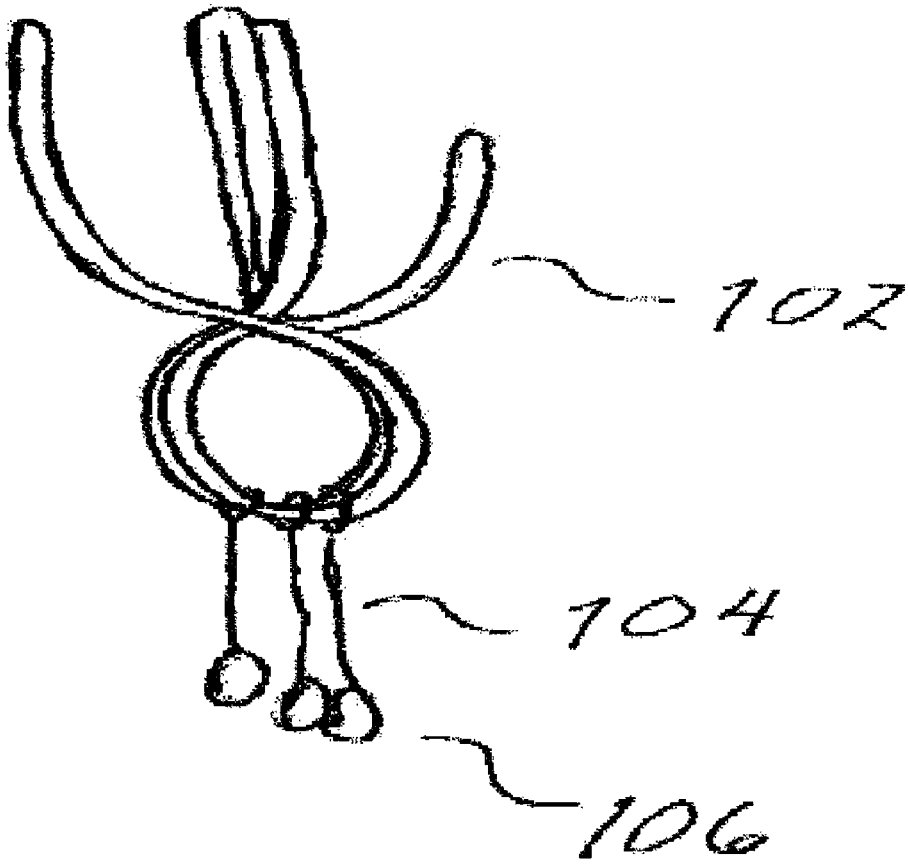
FIG. 3 depicts another embodiment of the present device.

FIG. 3 depicts a perspective view of another embodiment of the present device. In some embodiments, as shown in FIG. 3, the attachment member 102 can be a spring clip, clasp, clamp, pin, clothespin and/or any other known and/or convenient mechanism, which can be made of metal, plastic, and/or any other known and/or convenient material. In some embodiments, a plurality of weight assemblies 106 can be used.

Figure 4:
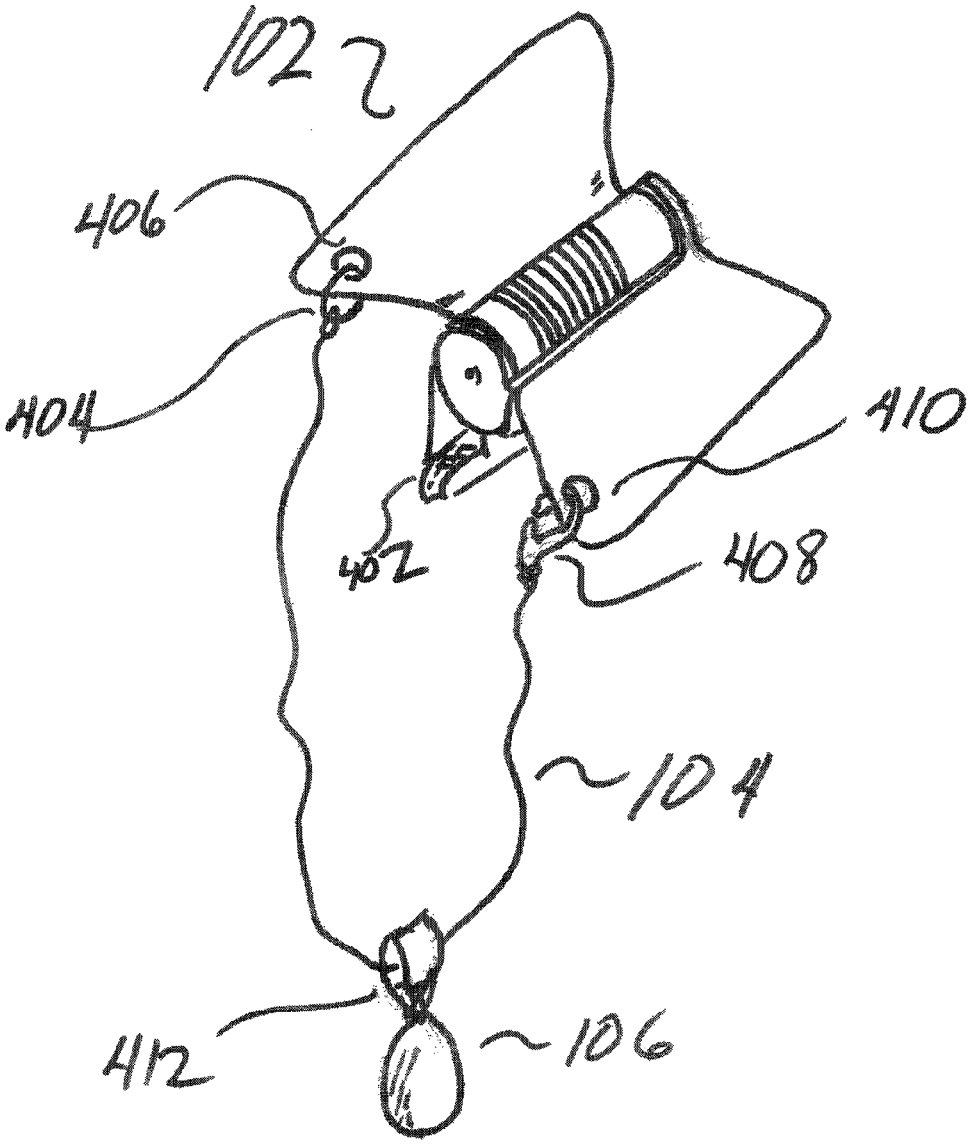
FIG. 4 depicts a perspective view of an alternate embodiment of the present device.

FIG. 4 depicts a perspective view of another embodiment of the present device. In some embodiments, as shown in FIG. 4, an attachment member 102 can be a spring-loaded clip, but in other embodiments can be any other known and/or convenient device. In some embodiments, the gripping surface 402 of an attachment member 102 can further comprise an adhesive, textured, or any other known and/or convenient friction-increasing device. In some embodiments, an attachment member 102 can have a decorative configuration, such as a butterfly, flower, abstract design, or any other known and/or convenient motif or design.

In some embodiments, a connecting member 104 can have a first end and a second end. As shown in the embodiment in FIG. 4, at least one end of a connecting member 104 can be removably connected to any point or component of an attachment member 102. In alternate embodiments, at least one end of a connecting member 104 can be substantially affixed to any point or component of an attachment member 102. As shown in the embodiment in FIG. 4, a connecting member 104 can be a cord, band, chain, or other substantially flexible, linked member. A first end of a connecting member 104 can be affixed to an attachment member 102 via at a closed loop 404 at the first end of a connecting member 104 that can pass through a fenestration 406 in a surface of an attachment member 104. In other embodiments, a closed loop 404 can also be formed by threading a connecting member 104 through a fenestration 406 and sealing a closed loop 404 with a crimping bead or other known and/or convenient device. In alternate embodiments, a closed loop 404 can be formed by a connecting member 104 looping upon itself or by any other known and or convenient knot. As shown in the embodiment in FIG. 4, a first fenestration 406 can be located substantially proximal to an edge of an attachment member 104, but in other embodiments can be in any other known and/or convenient position.

As shown in FIG. 4, a second end of a connecting member 104 can terminate in a coupling device 408, which in the embodiment shown can be a clip clasp, or snap, but in other embodiments can be any other known and/or convenient device. In the embodiment shown, a coupling device 408 can connect a second end of a connecting member 104 to an attachment device 102 by passing through a second fenestration 410 in a surface of a connecting member 102. As shown in the embodiment in FIG. 4, a second fenestration 410 can be located substantially proximal to an edge of an attachment member 104, but in other embodiments can be in any other known and/or convenient position. In the embodiment shown in FIG. 4, a first and a second end of a connecting member 102 can connect to an attachment member 104 at different points or via different fenestrations 406 410, but in other embodiments can connect to an attachment member at a substantially common point.

As shown in the embodiment in FIG. 4, having an attachment member 102 comprising a spring-loaded clip, a first end and a second end of a connecting member 104 can be connected to points located on the opposing lever arms of such a device.

In some embodiments, as shown in FIG. 4, a weight assembly 106 can be slidably connected to a connecting member 104 via a loop structure 412 affixed to a weight assembly 106 that can substantially surround a connecting member 104. As shown in FIG. 4, a loop structure 412 can be closed, but in other embodiments can be non-continuous to form a removable connection between a weight 106 and a connecting member 104.

Figure 5:
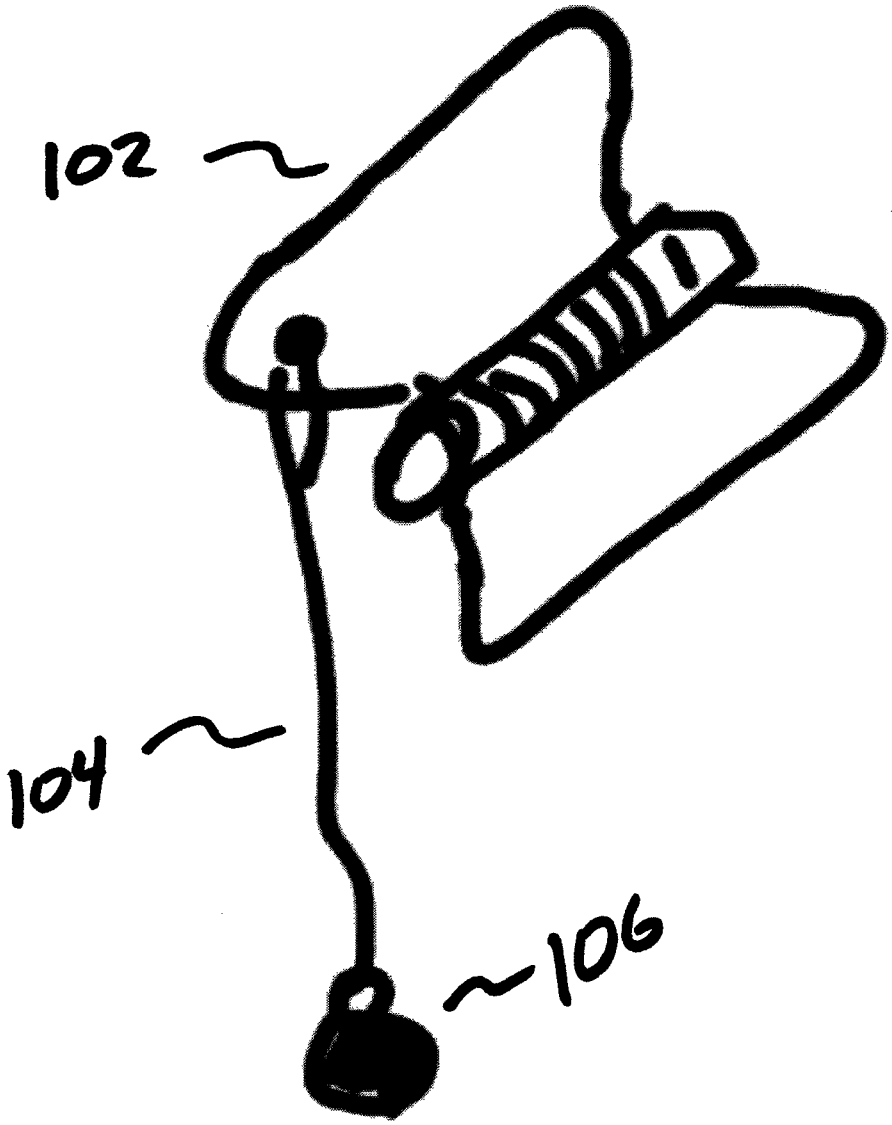
FIG. 5 depicts a perspective view of an alternate embodiment of the present device.

FIG. 5 shows another embodiment of the present device. As shown here, the first end of a connecting member 104 can be connected to a point on an attachment member 102, while the second end of a connecting member 104 can be attached to a weight assembly 106.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A device to hold a garment in place comprising:

an attachment member;

at least one weight assembly;

an opening in said weight assembly forming a loop structure; and a connecting member having a first end and a second end;

wherein the first end and the second end of said connecting member are connected to at least one point on said attachment member, and said weight assembly is slidably connected to said connecting member via said loop structure; and wherein said attachment member comprises: at least one fenestration in a surface of said attachment member;

a closed loop connected to a first end of said connecting member and connected to said at least one fenestration; and a coupling device connected to the second end of said connecting member and connecting to said attachment device via said at least one fenestration.

2. A device to hold a garment in place comprising:

an attachment member, wherein said attachment member is a spring-loaded clip having opposing lever members, each having a surface, comprising a first lever member and a second lever member said first lever member comprising a first fenestration in said surface, and said second lever member comprising a second fenestration in said surface;

at least one weight assembly;

an opening in said weight assembly;

a connecting member having a first end and a second end;

wherein the first end of said connecting member terminates in a closed-loop structure that passes through said first fenestration, thereby connecting the first end of said connecting member to said attachment member;

wherein the second end of said connecting member terminates in a removable coupling device that passes through said second fenestration, thereby connecting the second end of said connecting member to said attachment member;

and wherein said weight assembly is slidably connected to said connecting member via said opening in the weight assembly.

3. A device to hold a garment in place comprising:

an attachment member;

at least one weight assembly;

an opening in said weight assembly forming a loop structure; and a connecting member having a first end and a second end;

wherein the first end and the second end of said connecting member are connected to at least one point on said attachment member, and said weight assembly is slidably connected to said connecting member via said loop structure; and wherein said attachment member comprises:

a first fenestration and a second fenestration in at least one surface of said attachment member;

a closed loop connected to a first end of said connecting member and connected to said first fenestration; and a coupling device connected to the second end of said connecting member and connecting to said attachment device via said second fenestration.

* * * * *